US011801974B2

(12) United States Patent
Merritt

(10) Patent No.: US 11,801,974 B2
(45) Date of Patent: Oct. 31, 2023

(54) DISPENSER TIPS AND METHODS OF USE

(71) Applicant: Alyse Merritt, Odessa, FL (US)

(72) Inventor: Alyse Merritt, Odessa, FL (US)

( * ) Notice: Subject to any disclaimer, the term of this patent is extended or adjusted under 35 U.S.C. 154(b) by 0 days.

(21) Appl. No.: 16/661,870

(22) Filed: Oct. 23, 2019

(65) Prior Publication Data

US 2020/0122891 A1 Apr. 23, 2020

Related U.S. Application Data

(60) Provisional application No. 62/749,637, filed on Oct. 23, 2018.

(51) Int. Cl.
*B65D 25/38* (2006.01)

(52) U.S. Cl.
CPC ..... *B65D 25/38* (2013.01)

(58) Field of Classification Search
CPC ..... B65D 25/38; B65D 25/40; B65D 25/42; B65D 5/16; B65D 5/722; B65D 5/727; B65D 5/741; B65D 5/742; B65D 5/743; B65D 35/36; B65D 35/38; B65D 2231/022; B43K 1/00; B43K 1/01; B43K 8/003; B43K 8/03; B43K 8/14
USPC ..... 222/541.6, 541.9
See application file for complete search history.

(56) References Cited

U.S. PATENT DOCUMENTS 1,907,350 A * 5/1933 Fried ..... B65D 25/38 604/310
2,904,225 A * 9/1959 Earles, Jr. ..... B65D 47/2031 222/212
3,832,071 A * 8/1974 Chaney ..... B43K 5/1845 401/260
4,779,736 A * 10/1988 Geasland ..... B65D 25/38 206/524.8
4,872,778 A * 10/1989 Longo ..... B65D 35/38 401/266
5,029,738 A * 7/1991 Dillon ..... B05C 17/00596 222/527
5,046,877 A * 9/1991 Longo ..... B05C 17/00596 401/266
5,344,322 A * 9/1994 Wilcox ..... B44D 2/00 434/81
5,497,913 A * 3/1996 Baker ..... A61C 9/0026 222/102
6,357,631 B1 * 3/2002 Zaksenberg ..... B65D 81/3261 222/212
8,701,947 B2 * 4/2014 Weyts ..... B65D 35/56 222/215
2007/0025807 A1 * 2/2007 Liberatore ..... B65D 25/42 401/266
2016/0144993 A1 * 5/2016 George ..... B65D 15/08 229/404
2021/0122184 A1 * 4/2021 Agbeyteye ..... B43K 24/08

* cited by examiner

*Primary Examiner* — Patrick M. Buechner
(74) *Attorney, Agent, or Firm* — The Concept Law Group, PA; Scott D. Smiley; Scott M. Garrett

(57) ABSTRACT

A dispenser has a product chamber and an applicator tip. The product chamber has at least two walls, connected by at least one seal and having an applicator tip. The dispenser is configured so that it can be stood on one end, with the applicator tip at the opposite end.

3 Claims, 14 Drawing Sheets

DISPENSER TIPS AND METHODS OF USE

CROSS REFERENCE TO RELATED APPLICATIONS

This application claims priority of U.S. Provisional Application 62/749,637, entitled "Product Dispenser Tips", filed on Oct. 23, 2018, which is hereby incorporated by reference into this disclosure.

FIELD OF INVENTION

The invention relates generally to product dispenser tips and methods for use. Specifically, the invention discloses a dispenser having at least one product chamber in fluid communication with a product dispenser tip and method of using such dispensers.

BACKGROUND OF INVENTION

Disposable product dispensers (e.g., foil, plastic or plasticized paper dispensers) have been available for decades and provide convenient, disposable packaging for products such as condiments (e.g., ketchup, mustard, mayonnaise, soy sauce, and the like), soaps, conditioners, cosmetics, adhesives, paints, perfume, oils, and/or other substances.

In some dispensers, two layers of foil (or other material) are brought together and heat sealed or glued near the perimeter thereof along the various sides of the material. A suitable pre-perforation, or weaker material, is formed at or near a junction point between two sides of the condiment dispenser so as to permit easy cutting of this junction point away from the rest of the device. Thus, a user cuts along this portion removing a piece of material of the junction zone and proceeds to dispense the material from the cut area.

However, there are problems with this approach in that the current system can potentially be messy, leaving condiment material on the external surface of the dispenser. Also, the cutting or tearing of the junction may not be easy to perform.

Accordingly, there remains a need in the art for dispenser tips that more readily dispense material in a controlled and/or accurate manner, help maintain a clean surface of the dispenser, and permit the simple and easy opening of the dispenser.

SUMMARY OF THE INVENTION

The disclosed dispenser comprises a product chamber and an applicator tip.

The product chamber has at least two walls, with the first wall having at least a first side and the second wall having at least a second side. The walls are formed of an elastic material. Nonlimiting examples include cardboard, high density fiberboard, high density paper, metalized film, foil laminate film, MYLAR™, a formed metal sheet, plastic, or any other moisture and/or water impermeable material. Non-limiting examples of plastic include acrylonitrile butadiene styrene (ABS), high impact polystyrene (HIPS), acrylic (PMMA), cellulose acetate, cyclic olefin copolymer (COC), ethylene-vinyl acetate (EVA), ethylene vinyl alcohol (EVOH), polyvinylfluoride (PVF), polyvinylidene fluoride (PVDF), polytetrafluoroethylene (PTFE), polychlorotrifluoroethylene (PCTFE), fluorinated ethylene-propylene (FEP), perfluoroalkoxy polymer (PFA), polyethylenechlorotrifluoroethylene (ECTFE), polyethylenetetrafluoroethylene (ETFE), perfluoropolyether (PCPE), acrylic/PVC polymer, aromatic polyester polymers (liquid crystal polymer), polyoxymethylene (acetal), polyamide (PA, nylon), polyamide-imide (PAI), polyaryletherketone (PAEK), polybutadiene (PBD), polybutylene (PB), polybutylene terephthalate (PBT), polycaprolactone (PCL), polychlorotrifluoroethylene (PCTFE), polyethylene terephthalate (PET), polycyclohexylene dimethylene terephthalate (PCT), polycarbonate (PC), polyhydroxyalkanoate (PHA), polyketone (PK), polyester, polyethylene (PE), polyetheretherketone (PEEK), polyetherimide (PEI), polyethersulfone (PES), chlorinated polyethylene (CPE), polyimide (PI), polylactic acid (PLA), polymethylpentene (PMP), polyphenylene oxide (PPO), polyphenylene sulfide (PPS), polyphthalamide (PPA), polypropylene (PP), polystyrene (PS), polysulfone (PSU), polytrimethylene terephthalate (PTT), polyurethane (PU), polyvinyl acetate (PVA), polyvinyl chloride (PVC), polyvinylidene chloride (PVDC), styrene-acrylonitrile (SAN). In some variations, the walls are made with original material, recyclable material, biodegradable material, compostable material, or a combination thereof.

The walls of the product chamber are joined by at least one seal, disposed along the at least a first side and the at least a second side. However, some variations of the invention include additional sides. For example, in some embodiments of the invention, the first wall includes a first longitudinal side, a second transverse side, and a third longitudinal side, and the second wall includes a fifth longitudinal side, a sixth transverse side, and a seventh longitudinal side. In these variations, the at least one seal is a first set of seals, and includes a first seal disposed along the first longitudinal side and fifth longitudinal side, and connecting the first wall and the second wall; a second seal disposed along the second transverse side and sixth transverse side, and connecting the first wall and the second wall; and a third seal disposed along the third longitudinal side and seventh longitudinal side, and connecting the first wall and the second wall. The product chamber may also include additional sides or edges. For example, the first wall can include at least a fourth transverse side, with the second wall having at least an eighth transverse side. In this embodiment, the first set of seals further includes a fourth seal disposed along the fourth transverse side and connecting the first wall and the second wall.

The product chamber can be shaped in any geometric form, or commercially acceptable form. Non-limiting examples include geometrical shapes such as circles, triangles, squares, rectangles, diamonds, hearts, octagons. Other exemplary shapes include shapes such as sun, moons, stars, or horseshoes, apples (e.g., for juices and apple sauce), grapes, pear, banana, strawberries, blueberries, oranges, peaches, cherries, mangos, tomatoes (e.g., for ketchup), carrots (e.g., for baby carrot food), celery, mushrooms (e.g., for cream of mushroom soup), peanuts (e.g., for peanut butter), and similar shapes.

Other exemplary shapes include animal shapes such as teddy bear (e.g., for honey), panda (e.g., for soy sauce), cat shape, dog shape, pig (e.g., for bacon bits), other animals, giraffe, zebra (e.g., for chocolate & vanilla products mixed together), bees (e.g., for honey), butterflies/fun insects, etc. In an animal shaped dispenser, an animal finger, animal face/mouth, or basically any body part of the animal can dispense any product.

Other exemplary shapes can include character shapes (e.g., Disney™ character, Universal™ characters, DC Comics™ characters, Marvel Comics™ characters, or other licensed or unlicensed character shapes) such as princess shapes (e.g., to hold princess glitter), prince shape, frog shape, villain character shapes (e.g., to hold dark desert toppings—chocolate, caramel, etc.). Disney™ or other character shapes could be used to hold condiments or other products at theme parks or other entertainment venues associated with character owner (e.g., Disney™) or theme.

Yet other exemplary shapes can include bottle shapes such as an alcohol bottle (e.g., for alcohol shots), salad dressing bottle shape (e.g., for salad dressings), perfume bottle shape (e.g., for perfume and lotion), sand-in-a-bottle or ship-in-a-bottle shapes (e.g., for beach theme/sunblock or suntan lotion).

Some other exemplary shapes include body shapes such as a woman's bodice (that can be modestly covered) for lotions, woman's silhouetted hourglass figure (for lubrications or gels/perfumed), etc.

And other exemplary shapes include pharmaceuticals/apothecary shapes such as a thermometer shape (e.g., for children's single dose pain reliever or cold medicine, etc.), a needle syringe shape (e.g., for insulin), snake and staff pharmacy shape (e.g., for other medicines), a stethoscope, a skull and cross bones shape (e.g., for toxic substances).

Yet other exemplary shapes include cosmetics such as a lipstick shape (e.g., for lipstick and lip gloss), eyeball shape with lashes that release product (e.g., for liquid eye-liners and eye shadows), pretty woman face shape (e.g., for blush or other cosmetics), etc.

Still other exemplary shapes include tool shapes such as a hammer shape, nuts and bolts shape, spreading metal tool shape (e.g., for spackle or plaster), oil can shape (e.g., for oils or machinery lubricants), a glue bottle shape, finger nail shape (other shapes for adhesives), sports and school/university themed shapes such as baseball, bat, glove, team logo, team mascots shapes, team name shape, include different country shapes such as U.S.A. (e.g., 4th of July treats), Ireland (alcohol or Irish coffee), or Eiffel Tower shape (French creams, food or drink), solar system shapes such as planets (e.g., deliver glitter), delivers all condiments, creamers, for space-themed parks.

The product chamber optionally includes a second set of seals. The second set of seals include at least a first interior seal disposed interior to the at least one seal, and where the at least a first interior seal is disposed along the at least a first side and the at least a second side, and connecting the first wall and the second wall. In some embodiments, the second set of seals includes a second interior seal disposed interior to the second seal, and a third interior seal disposed interior to the third seal. Other embodiments include a fourth interior seal disposed interior to the fourth seal. Additional seals can be used to form a desired shape, as would be apparent to one of skill in the art.

Some variations of the product chamber include a transverse internal expansion spring or longitudinal internal expansion spring. The transverse internal expansion spring is formed from a first spring leaf having a first spring leaf end and a second spring leaf end and a second spring leaf having a third spring leaf end and a fourth spring leaf end. The two spring leafs, i.e. the first spring leaf and the second spring leaf, are connected at their respective ends to one another, such that the ends are in close proximity but the center of the spring leaf, or about the center of the leaf, is spaced apart, thereby forming an almond shape. The transverse internal expansion spring is disposed in the interior of the product chamber, between the first wall and the second wall, and extending from the first longitudinal side to the third longitudinal side. Alternatively, the transverse internal expansion spring is integrated into the seals of the first longitudinal side to the third longitudinal side. The longitudinal internal expansion spring is formed of a first spring leaf and a second spring leaf, and constructed similarly to the transverse internal expansion spring, but extends from the second transverse side to the at least a fourth transverse side. The two leafs are formed of plastic, an elastic metal or shape-memory metal. The two spring leafs are connected by welding, adhesive, polymerized resin, or other means known in the art.

The applicator tip is optionally an inverted tip, an applicator dispenser tip, a brush applicator tip, a shaped dispenser tip, a rolling dispenser applicator tip, an atomizing applicator tip, a flow applicator tip, a tear applicator tip, or a shaker applicator tip. The applicator tips optionally have various shapes. In some variations, the shape is in profile, or in three-dimensions. Non-limiting examples include oval, rounded, angled, floral, heart-shaped, character-shaped (such as those described for the product chamber).

The inverted tip includes at least two tip seals, at least a first tip seal and a second tip seal, where the first tip seal and second tip seal that terminate in an inverted point, i.e. form a chevron-shaped void pointing toward the center of the product chamber. The inverted tip optionally includes a third tip seal disposed adjacent to the first tip seal and between the at least one seal and the first tip seal and a fourth tip seal disposed adjacent to the second tip seal and between the at least one seal and the second tip seal, with the first tip seal and second tip seal terminate in an inverted point.

The applicator dispenser tip includes a porous applicator, with a dispenser tube having a first end in communication with the porous applicator and a second end in fluid communication with the interior of the product chamber. The porous application may be a porous elastomer. The brush applicator tip includes a brush applicator with a brush dispenser tube having a first end in communication with the brush applicator and a second end in fluid communication with the interior of the product chamber. In some variations, the brushes (e.g., on the designs disclosed herein having a brush applicator) could also have hollow, cylindrical-type bristles in their brushes (e.g., capable for suction and especially in conjunction with the expansion valve disclosed herein to be able to massage and/or suction dirt, make-up or other contaminants from skin. The shaped dispenser tip includes a shaped applicator with a shaped dispenser tube having a first end in communication with the shaped applicator and a second end in fluid communication with the interior of the product chamber. The shaped application optionally includes a concave face, allowing for application of material to a lip or other convex surface. The rolling dispenser applicator tip includes a roller applicator comprising a round or semi-spherical porous material, with a dispenser neck having a first end in communication with the roller applicator and a second end in fluid communication with the interior of the product chamber. The atomizing applicator tip includes an atomizing dispenser neck, wherein the atomizing dispenser neck has a first end extending from the product chamber and a second end in fluid communication with the interior of the product chamber, and an atomizer disposed adjacent to the first end of the atomizing dispenser neck. In some variations, the atomizer includes a first chamber in fluid communication with a tube, which is subsequently in fluid communication with a second chamber. The first chamber adapted to accept a fluid, and has a first end having a first diameter and a second end having a second diameter, with the second diameter is smaller than the first diameter. The tube has a first end and a second end, with the first end of the tube is disposed on the second end, and where the tube has a diameter equivalent to the second diameter. The second chamber having a third end with the second diameter and disposed on the second end of the tube, and fourth end having a third diameter, where the third diameter is larger than the second diameter.

The flow applicator tip includes a dispenser neck having a first end in communication with the shaped applicator and a second end in fluid communication with the interior of the product chamber, and a one-way flow valve is disposed in the interior of the dispenser neck. The tear applicator tip includes a tear tip seal disposed adjacent to the first seal, where the tear tip seal includes a first tear seal and a second tear seal, and the first tear seal and the second tear seal connect at a tear seal angle to form a tear tip. A tear tab disposed adjacent to the tear tip, such that the tear tab is perpendicular to an angle bisector of the tear seal angle; or the tear tab is parallel to an angle bisector of the tear seal angle, and the tear tab is in communication with a perforated line or opening on at least one wall. The shaker applicator tip includes a plurality of openings disposed on one wall of product chamber. The shaker applicator optionally includes a tear tab having a sealable flap, where the tear tab is parallel to the shaker applicator tip, such that the sealable flap is in communication with a plurality of openings disposed on one wall of product chamber.

In some variations, the applicator tip optionally includes a rupturable membrane disposed in the applicator tip. In such variations, the rupturable membrane is formed of plastic film, foil, metalized film, foil laminate film, or formed metal sheet, such as MYLEX™, NATUREFLEX™, or NM30.

Variations of the applicator tip optionally include a one-way valve disposed in the applicator tip. The one-way valve optionally includes a deformable tab, wherein the deformable tab is dimensioned to sealably fit in the interior of the applicator tip, and a valve spring or valve retaining tip disposed on a first side of the deformable tab.

The dispensers disclosed herein can work in conjunction with others in this filing, or can operate independently of the over variations disclosed herein. Further, the dispensers can be made to be rigid, semi-rigid, as well as flexible in material.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1A:
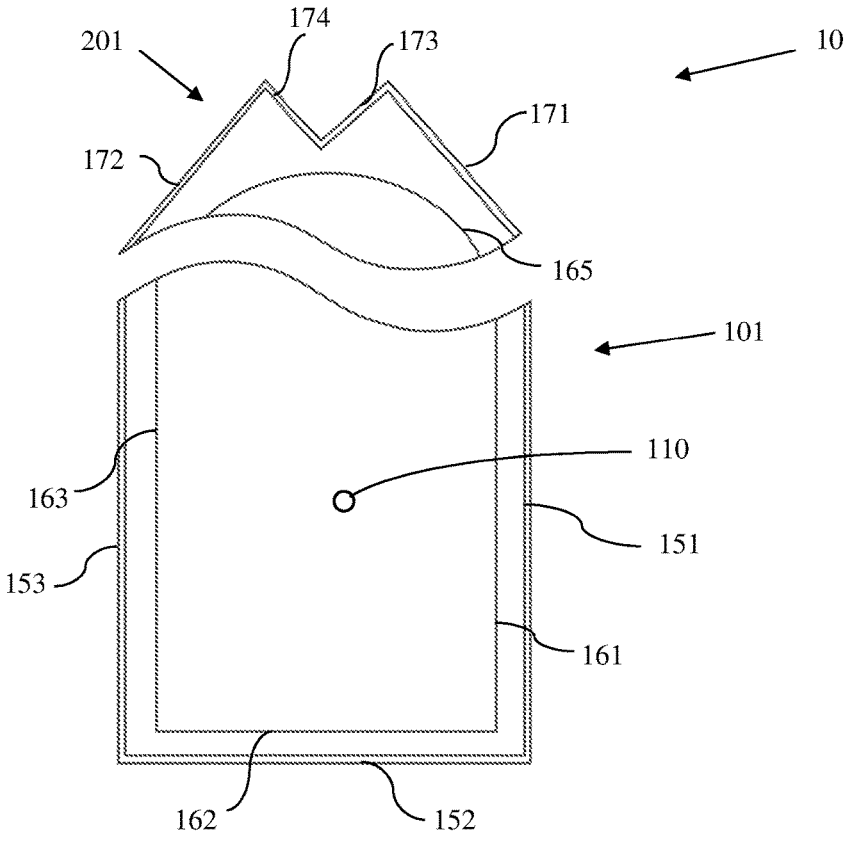
FIG. 1A is a top-down diagram of an inverted tip dispenser. An internal seal is illustrated as an optional embodiment.

As used herein, the singular forms "a," "an" and "the" include plural referents unless the context clearly dictates otherwise. Thus, for example, reference to "a polypeptide" includes a mixture of two or more polypeptides and the like.

As used herein, "about" means approximately or nearly and in the context of a numerical value or range set forth means +/−15% of the numerical.

As used herein, "inverted point" means a chevron-shape having an orientation directed toward the center of the product chamber.

As used herein, "fluid" means liquids, gases, solutions, gels, and foams. Non-limiting examples include condiments, like mustard and ketchup, pastes, aerosol hair products, shaving gel, water, mouth washes, liquid medications, and other similar materials.

As used herein, "semi-fluid" granular solids, and any other flowable non-gas phased composition.

As used herein, "plastic" means a polymerized organic material material, such as those disclosed in paragraph [00], disclosed herein, and elastomers. Non-limiting examples of elastomers include polyisopropene, polybutadience, chloroprene, neoprene, polychloroprene, butyl rubber, styrene-butadiene, nitrile rubber, ethylene propylene rubber, epichorohydrin rubber, polyacrylic rubber, silicone, flurosilicone, polyether amides, polyethylene, and ethylene-vinyl acetate.

As used herein, "elastic metal" means a metal that deforms upon application of pressure by human hand or up to twice the pressure exerted by human hand and returns to an original shape upon removal of the load. Non-limiting examples include copper-aluminum-nickel alloys, nickel-titanium alloys, zinc alloys, copper alloys, iron alloys, such as Fe—Mn—Si, Cu—Zn—Al, Cu—Al—Ni, Ni—Ti, Ag—Cd, Au—Cd, Co—Ni—Al, Co—Ni—Ga, Cu—Al—Be—Zr, X Cu—Al—Be—B, Cu—Al—Be—Cr, Cu—Al—Be—Gd, Cu—Al—Ni, Cu—Al—Ni—Hf, Cu—Sn, Cu—Zn, Cu—Zn—Si, Cu—Zn—Al, Cu—Zn—Sn, Fe—Mn—Si, Fe—Pt, Mn—Cu, Ni—Fe—Ga, Ni—Ti—Hf, Ni—Ti—Pd, Ni—Mn—Ga, and Ti—Nb. In some variations, the elastic material deforms upon application of 250 kPa or less of pressure and can withstand at least 500 kPa of pressure without losing elasticity.

As used herein, the term "longitudinal" means the axis running substantially parallel to the maximum linear dimension of the inventive article.

As used herein, the term "transverse" means the axis running substantially perpendicular to the maximum linear dimension of the inventive article.

As used herein, the term "substantially perpendicular" means within a 20° deviation from a right angle, i.e. perpendicular, to the reference object.

The tips and/or dispensers disclosed herein are not limited to a type of product that can be stored and/or dispensed, but rather can hold and dispense any suitable products such as liquids, gels, creams, and other fluid or semi-fluid materials. Non-limiting examples include condiments, beverages, natural and/or artificial sweeteners, jellies, jams, preserves, syrups, toothpaste, personal care products (shampoo, soap, conditioner, etc.), liquids, lotions, gels, adhesives, cosmetics, paints, pharmaceuticals (e.g., topical, oral or other gels, lotions, pastes, etc.), etc.

The tips and/or dispensers disclosed herein are described using exemplary materials, but the invention is not intended to be limited to being made from one specific material, but rather can be made from any suitable material or combination of materials including recyclable and/or recycled materials such as paper, cardboard, plastics, foil, condiment materials, and/or recyclable polymers, etc.

The tips disclosed herein can be affixed to any shape or size of dispenser packet. For example, non-limiting exemplary dispenser packet shapes can include an arrow, a circle (e.g., tomato ball), a peanut, a diamond, a heart, a carrot (e.g., for baby carrot food), a lipstick shape (e.g., for sample lipstick gels at cosmetics counters), a bottle shape (e.g., to store and dispense alcohol shots, energy drinks, electrolyte drink shots, for example for runners, marathoners and bike riders), a finger shape, a character shape (e.g., a children's story or movie character, a theme park character, etc.), a shape of a sensual body or body part for personal lubricants, etc. Similarly, the tips can be formed to resemble various shapes, such as, without limiting the scope of the invention, geometrical shapes like circles, triangles, squares, diamonds, hearts, octagons, sun, moons, stars, or horseshoes.

Example 1

Dispenser 10 is formed of a product chamber 101 and inverted tip 201, as seen in FIG. 1A. Liquid dispenser 10 may be made from any suitable material, such as plastic, paper, or other material disclosed herein. Product chamber 101 includes a first wall 110 and second wall 120 connected by at least one seal 150. The seal shown in the exemplary embodiment includes a first seal 151, along a longitudinal edge of first wall 110 and second wall 120, a second seal 152, along a transverse edge of first wall 110 and second wall 120, and a third seal 153, along a longitudinal edge of first wall 110 and second wall 120. The three seals, 151-153 for three walls of a single dispenser chamber 110, as seen in the Figure. Optionally, a second set of seals form an interior of the dispenser chamber, where the second set of seals includes one or more seals. As shown in the Figure, the second set of seals optionally includes first interior seal 161, second interior seal 162, third interior seal 163, and semi-spherical seal 165, optionally disposed near the inverted tip, such that the dispenser material is thinnest adjacent to the inverted tip.

Additionally, inverted tip 201 includes at least one tip seal 160. As seen in the Figure, the inverted tip has four seals, first tip seal 171, second tip seal 172, first inverted tip seal 173, and second inverted tip seal 174.

Figure 1B:
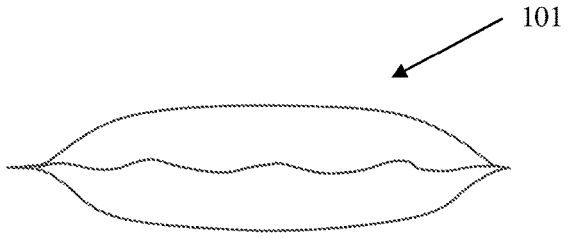
FIG. 1B is a side view diagram of an inverted tip dispenser.

In operation, product chamber 101 is filled with a fluid or semi-fluid material, as seen in FIG. 1B. As a user applies pressure to the product chamber, inverted tip 201 may rupture at a perforation or other weakened area to permit the product within the product chamber to be dispensed.

Example 2

Figure 2A:
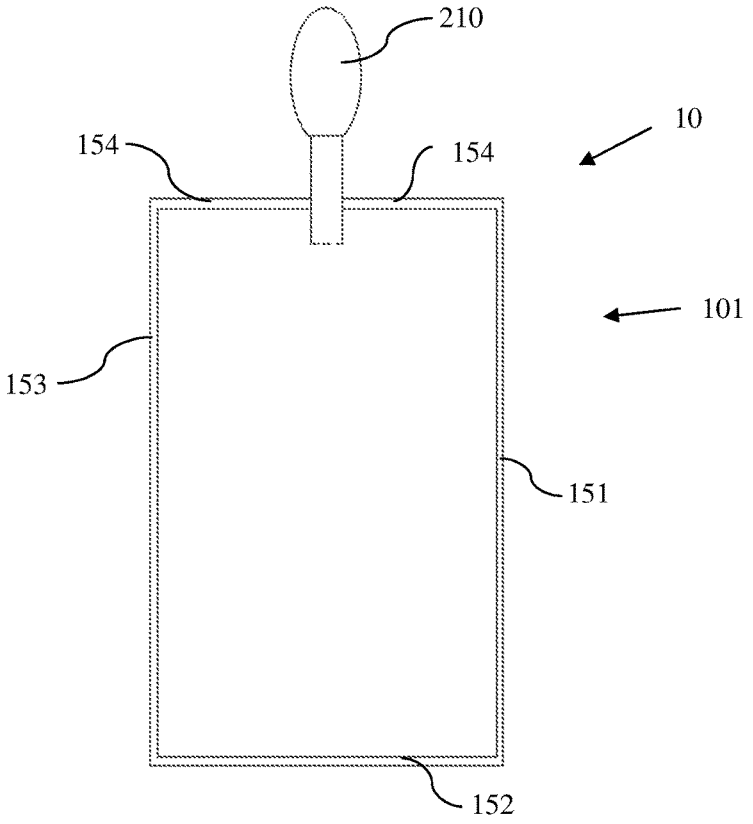
FIG. 2A is a top-down diagram of an applicator tip dispenser.

Dispenser 10 is formed of a product chamber 101 and applicator dispenser tip 210, as seen in FIG. 2A. Product chamber 101 is formed of any suitable material, that forms at least two walls, as described in Example 1. In an exemplary embodiment, the product chamber includes a first seal 151, along a longitudinal edge of first wall 110 and second wall 120, a second seal 152, along a transverse edge of first wall 110 and second wall 120, and a third seal 153, along a longitudinal edge of first wall 110 and second wall 120. The three seals, 151-153 for three walls of a single dispenser chamber 110, as seen in the Figure. Optionally, a fourth seal 154 is disposed on a second transverse edge.

Figure 2B:
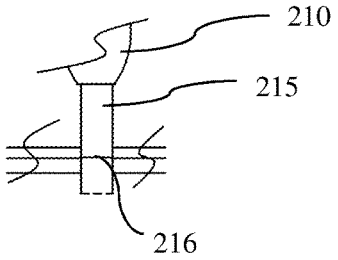
FIG. 2B is a side view diagram of an applicator tip with an optional membrane.

Applicator dispenser tip 210 is in fluid communication with dispenser tube 215, having membrane 216 disposed in the interior of dispenser tube 215, as seen in FIG. 2B. Dispenser tube 215 traverses through fourth seal 154 (or a combination of seals on the transverse edge), and extends to the interior space of product chamber 101, thereby connecting the interior space of product chamber 101 with applicator dispenser tip 210.

Figure 2C:
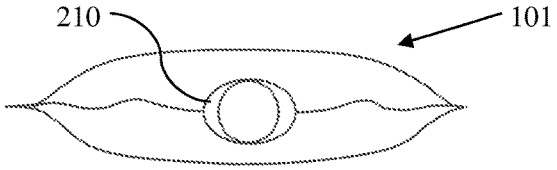
FIG. 2C is a top side view diagram of an applicator tip dispenser.
Figure 2D:
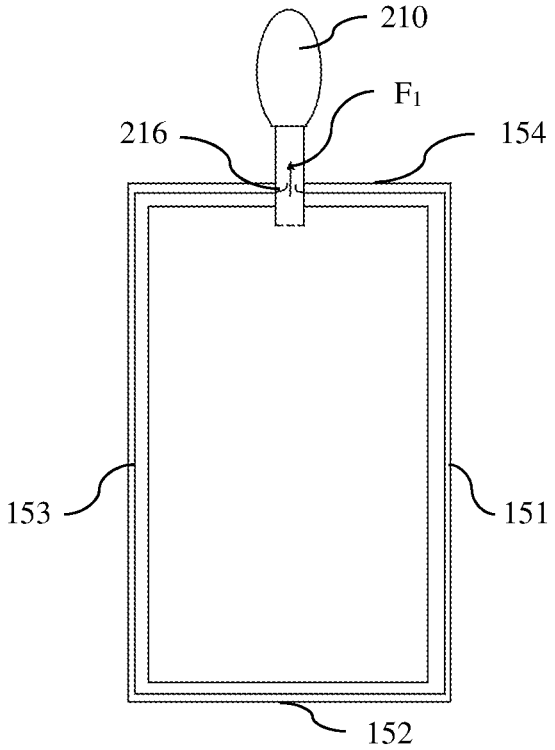
FIG. 2D is a top-down diagram of an applicator tip dispenser showing the rupture of an optional membrane.

In operation, product chamber 101 is filled with a fluid or semi-fluid material, as seen in FIG. 2C. As a user applies pressure to product chamber 101, the fluid or semi-fluid material builds pressure against membrane 216, until membrane 216 ruptures allowing fluid flow $F_1$ to the applicator dispenser tip, as shown in FIG. 2D. Fluid flow $F_1$ permits the product within the single product chamber dispenser to travel through dispenser tube 215 to applicator dispenser tip 210 to be dispensed or applied.

Figure 2E:
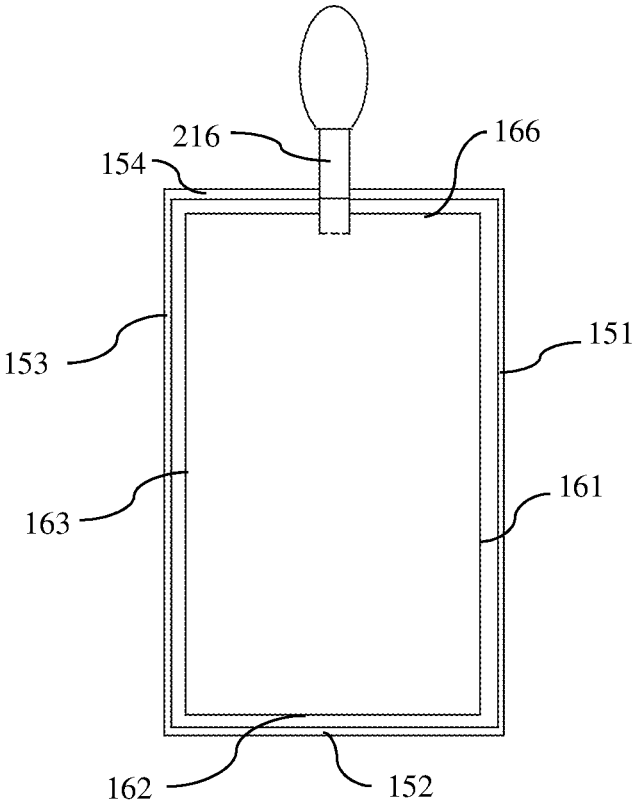
FIG. 2E is a top-down diagram of an applicator tip dispenser showing an optional internal seal set.

In certain variations of the invention, a second set of seals form an interior of the dispenser chamber, as discussed in Example 1. The interior seals seal three sides of product chamber 101, and include first interior seal 161, second interior seal 162, third interior seal 163, and fourth seal 166, disposed to permit dispenser tube 215 to extend to the interior space, as seen in FIG. 2E.

Figure 3:
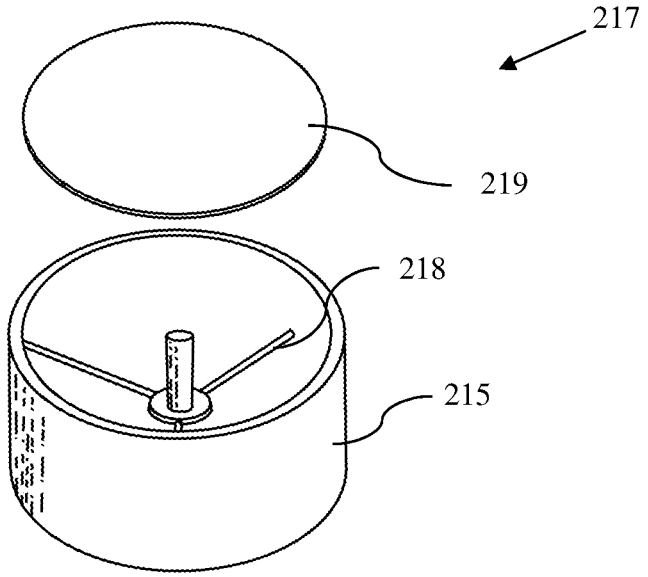
FIG. 3 is an isometric view of a one-way seal.

In some variations, liquid dispenser 10 includes a valve disposed in the interior of dispenser tube 215. While valve 217 can be disposed interior to membrane 216 or exterior to membrane 216, it is envisioned that in most variations, valve 217 is disposed exterior to membrane 216, thereby not contacting any fluid or semi-fluid until the rupture of membrane 216, as seen in FIG. 3. Valve 217 is comprised of a spring or support 218 disposed in the interior of dispenser tube 215. Spring or support 218 is optionally integrally mounted to the interior of dispenser tube 215. Alternatively, spring or support 218 is supported by the interior of dispenser tube 215, via a lip, ledge, or ring integrally disposed on the interior of dispenser tube 215. Sealable membrane 219 is placed onto spring or support 218, and optionally sealed in place by a lip, ledge, or ring.

Example 3

Figure 4A:
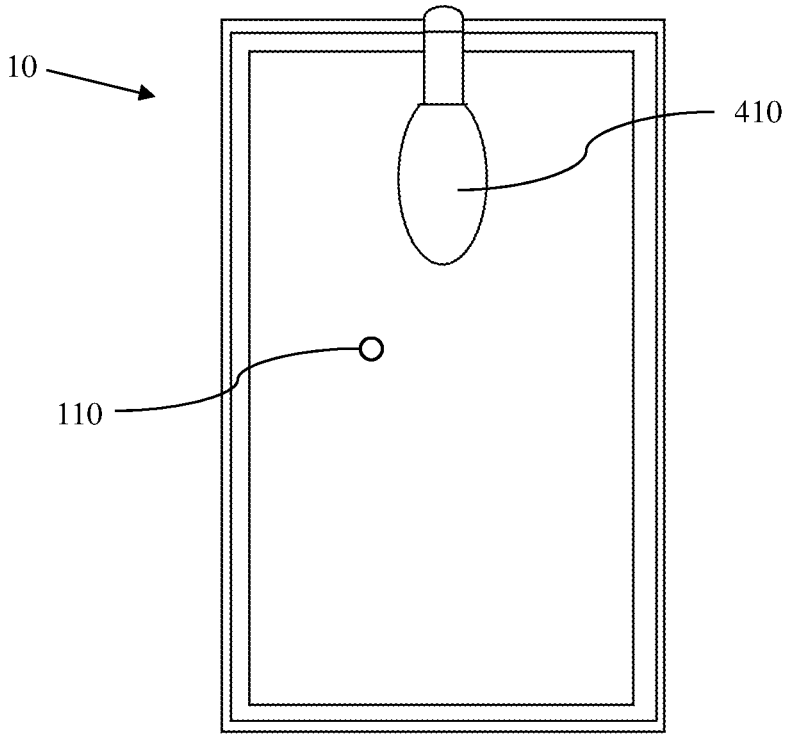
FIG. 4A is a top-down diagram of a folding dispenser tip.

Dispenser 10 is formed of a product chamber 101 and fold applicator dispenser tip 310, as seen in FIG. 4A. Product chamber 101 is formed of any suitable material, that forms at least two walls, with at least one seal, as described in Example 1. Fold applicator dispenser tip 310, is formed of applicator dispenser tip 310 is in fluid communication with dispenser tube 315.

Figure 4B:
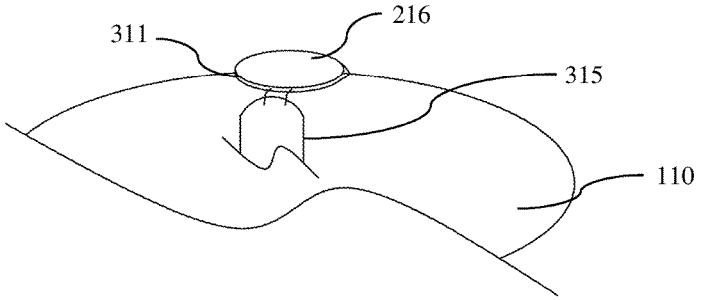
FIG. 4B is an isometric view of a folding dispenser tip

Product chamber 101 included port 311, having membrane 216 disposed over port 311, as seen in FIG. 4B. Dispenser tube 215 traverses through fourth seal 154 (or a combination of seals on the transverse edge), and extends to the interior space of product chamber 101, thereby connecting the interior space of product chamber 101 with applicator dispenser tip 210. In some implementations, the applicator tips can fold over (and be secured with cellophane). In some implementations, the applicator can eject from the interior of the tip. Alternatively, applicator dispenser tip 310 is a folded applicator dispenser tip held in place by an adhesive film.

Example 4

Figure 5A:
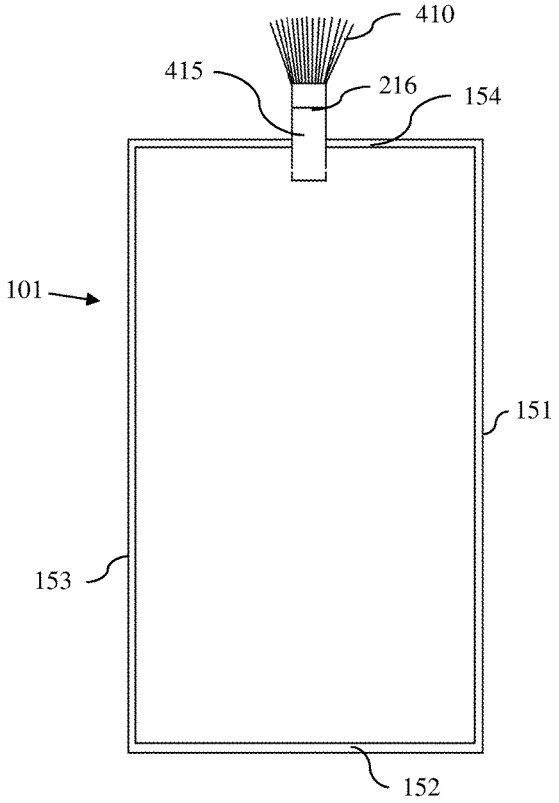
FIG. 5A is a top-down diagram of a brush applicator dispenser.

Dispenser 10 includes product chamber 101 and brush applicator tip 410, as seen in FIG. 5A. Product chamber 101 is formed of any suitable material, that forms at least two walls, and includes at least a first set of seals, as described in Example 1. In an exemplary embodiment, the at least a first set of seals includes a first seal 151, along a longitudinal edge of first wall 110 and second wall 120, a second seal 152, along a first transverse edge of first wall 110 and second wall 120, a third seal 153, along a longitudinal edge of first wall 110 and second wall 120, and a fourth seal 154 disposed on a second transverse edge.

Figure 5B:
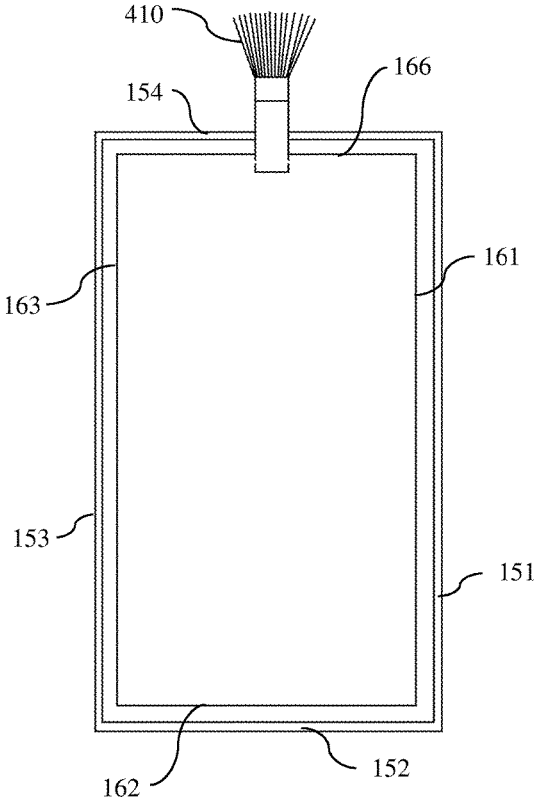
FIG. 5B is a top-down diagram of a brush applicator dispenser showing an optional internal seal set.

Brush applicator tip 410 is in fluid communication with brush dispenser tube 415. Optionally, brush dispenser tube 415 includes membrane 216 disposed in the interior of dispenser tube 415, as seen in FIG. 5B. Brush dispenser tube 415 traverses through fourth seal 154 (or a combination of seals on the transverse edge), and extends to the interior space of product chamber 101, thereby connecting the interior space of product chamber 101 with brush applicator tip 410.

Figure 5C:
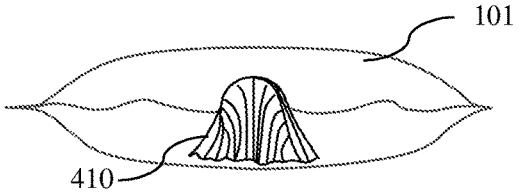
FIG. 5C is a top side view diagram of a brush applicator dispenser.

In operation, product chamber 101 is filled with a fluid or semi-fluid material, as seen in FIG. 5C. As a user applies pressure to product chamber 101, the fluid or semi-fluid material builds pressure against membrane 216, until membrane 216 ruptures allowing fluid flow $F_1$ to the applicator dispenser tip, as described in Example 2. Fluid flow $F_1$ permits the product within the single product chamber dispenser to travel through brush dispenser tube 415 to brush applicator tip 410 to be dispensed or applied.

In certain variations of the invention, a second set of seals form an interior of the dispenser chamber, as discussed in Example 1. The interior seals seal three sides of product chamber 101, and include first interior seal 161, second interior seal 162, third interior seal 163, and fourth seal 166, disposed to permit dispenser tube 215 to extend to the interior space.

Example 5

Figure 6A:
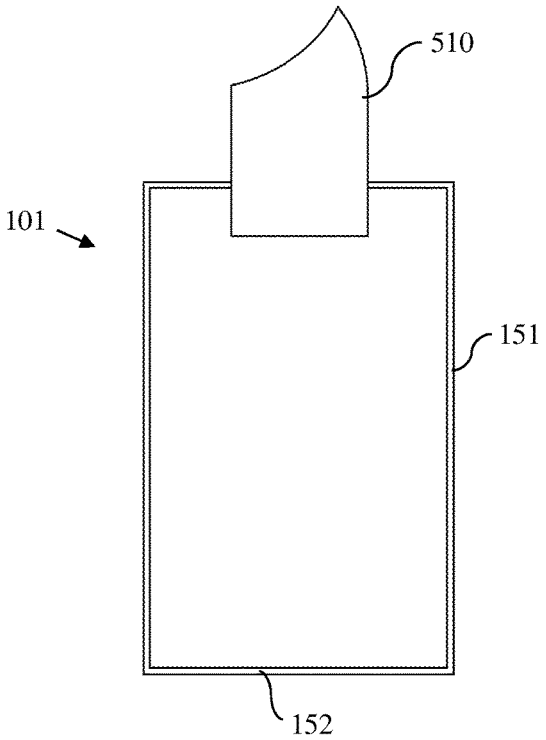
FIG. 6A is a top-down diagram of a shaped applicator dispenser.

Dispenser 10 includes product chamber 101 and shaped dispenser tip 510, as seen in FIG. 6A. Product chamber 101 is formed of any suitable material, that forms at least two walls, and includes at least a first set of seals, as described in Example 1. In an exemplary embodiment, the at least a first set of seals includes a first seal 151, along a longitudinal edge of first wall 110 and second wall 120, a second seal 152, along a first transverse edge of first wall 110 and second wall 120, a third seal 153, along a longitudinal edge of first wall 110 and second wall 120, and a fourth seal 154 disposed on a second transverse edge.

Shaped dispenser tip 510 is in fluid communication with the interior space of product chamber 101, thereby connecting the interior space of product chamber 101 with brush applicator tip 410. Optionally, shaped dispenser tip 510 includes membrane 216 disposed in the interior of the dispenser tip, as discussed in previous Examples.

Figure 6B:
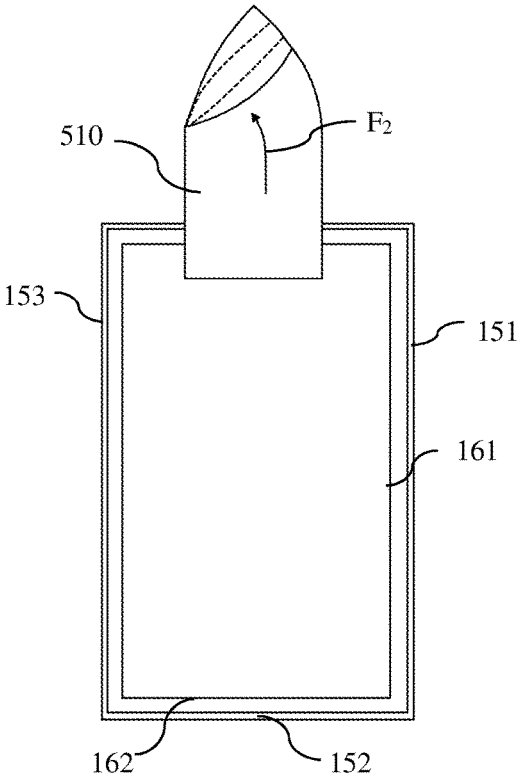
FIG. 6B is a top-down diagram of a shaped applicator dispenser showing product expelled from the dispenser.

A fluid or semi-fluid material is added to product chamber 101. When pressure is applied to product chamber 101, the fluid or semi-fluid material is dispensed from shaped dispenser tip 510. Where a membrane is used, the pressure of the fluid or semi-fluid material ruptures the membrane, allowing the fluid or semi-fluid material to flow to the tip as flow $F_2$, seen in FIG. 6B. Optionally, a one-way flow valve is disposed in the tip.

Example 6

Figure 7:
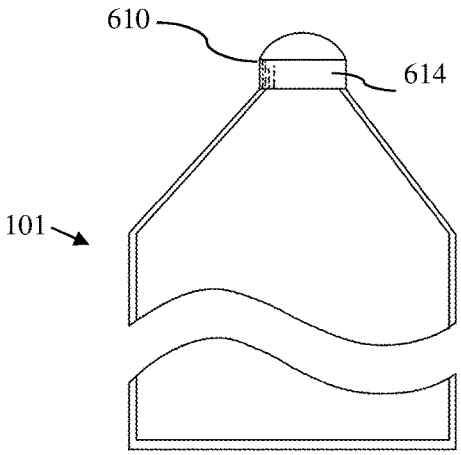
FIG. 7 is a top-down diagram of a roller applicator tip.

Dispenser 10 includes product chamber 101 and rolling dispenser applicator tip 610, as seen in FIG. 7. Product chamber 101 is formed of any suitable material, that forms at least two walls, and includes at least a first set of seals, as described in Example 1. In an exemplary embodiment, the at least a first set of seals, 151 through 154, as described in previous Examples. Product chamber 101 optionally includes second set of seals, 161 through 165, as described above. Rolling dispenser applicator tip 610 is configured to dispense in the form of a roll-on and/or glosser gliding component, emanating off of, on top of, or out of, the primary package. This roll-on component can accommodate a method of dispensing whereby a glossing effect for lipstick, lip gloss, perfumes, sanitizers, repellents, etc. may occur.

Rolling dispenser applicator tip 610 includes dispenser neck 614, which holds the roller dispenser and permits rotational adjustments. Optionally, rolling dispenser applicator tip 610 includes membrane 216 disposed in dispenser neck 614, and functions as discussed in previous Examples. In some variations, a one-way flow valve is disposed in dispenser neck 614.

Example 7

Figure 8:
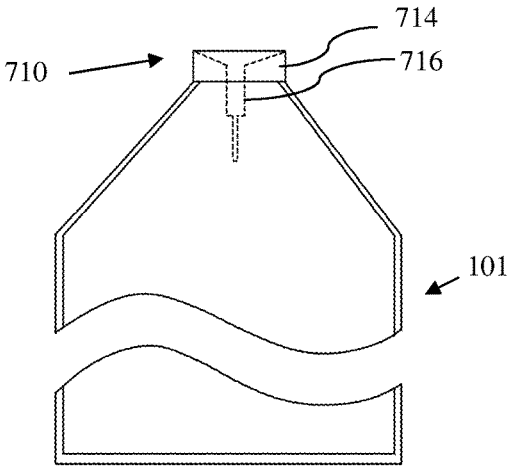
FIG. 8 is a top-down diagram of an aerosolizing or spray applicator tip.

Dispenser 10 includes product chamber 101 and atomizing applicator tip 710, as seen in FIG. 8. Product chamber 101 is formed of any suitable material, that forms at least two walls, and includes at least a first set of seals, as described in Example 1. In an exemplary embodiment, the at least a first set of seals, 151 through 154, as described in previous Examples. Product chamber 101 optionally includes second set of seals, 161 through 165, as described above. Atomizing applicator tip 710 is configured to dispense as a spraying or spritzing, emanating off of, on top of, or out of, the primary package.

Atomizing applicator tip 710 includes dispenser neck 714, which holds atomizer 716, and an atomizer, as would be readily apparent in the field, to achieve the spray or spritzing effect. Optionally, atomizing applicator tip 710 includes membrane 216 disposed in dispenser neck 714, and functions as discussed in previous Examples. In some variations, a one-way flow valve is disposed in dispenser neck 714. The atomizer optionally comprises a first chamber adapted to accept a fluid, where the first chamber comprises a first end having a first diameter and a second end having a second diameter, and where the second diameter is smaller than the first diameter. A tube is in fluid communication with the first chamber and has a first end and a second end, where the first end of the tube is disposed on the second end, where the tube has a diameter equivalent to the second diameter. A second chamber is in fluid communication with the tube, and has a third end with the second diameter and disposed on the second end of the tube, and fourth end having a third diameter, where the third diameter is larger than the second diameter.

Optionally, the atomizer head is formed of a translucent material in communication with a light source, such as a light emitting diode (LED). This illuminating component is disposed on top of the package and emits a glow that can be used in conjunction with, or separate from, other dispensing mechanisms. This light component can be taken apart from the package and can be solar, battery, LED or electrically operated.

Example 8

Figure 9:
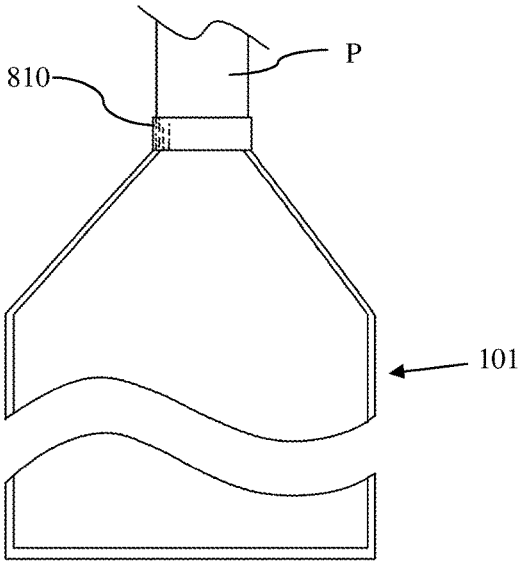
FIG. 9 is a top-down diagram of a squeeze applicator tip.

Dispenser 10 includes product chamber 101 and flow applicator tip 810, as seen in FIG. 9. Product chamber 101 is formed of any suitable material, that forms at least two walls, and includes at least a first seal of seals, as described in Example 1. In an exemplary embodiment, the at least a first set of seals, 151 through 154, as described in previous Examples. Product chamber 101 optionally includes second set of seals, 161 through 165, as described above. Flow applicator tip 810 is configured to dispense with a pull-down, push out system. Useful materials include, without limiting the scope of the invention, mini ice pops, mini candies or sucking elements, various types of foods or frozen drinks or edibles in solid form, as well as lipsticks, cosmetics or other items that can be pushed through this dispensing mechanism. There may be a squeezing or other allowable method on the package to cause to suction in the pop or lipstick or other item as well, as a push-out component.

Flow applicator tip 810 includes dispenser neck 814, which holds the flow tip. Optionally, flow applicator tip 810 includes membrane 216 disposed in dispenser neck 814, and functions as discussed in previous Examples. In some variations, a one-way flow valve is disposed in dispenser neck 814. Placing pressure on product chamber 101 results in fluid or semi-fluid material P ejection from the flow applicator tip 810, either completely expelling the material or partially expelling the material, which may be retracted back into product chamber 101 after use.

Example 9

Dispenser 10 includes product chamber 101 and tear applicator tip 910. Product chamber 101 is formed of any suitable material, that forms at least two walls, and includes at least a first set of seals, as described in Example 1. In an exemplary embodiment, the at least a first set of seals, 151 through 154, as described in previous Examples. Product chamber 101 optionally includes second set of seals, 161 through 165, as described above.

Figure 10A:
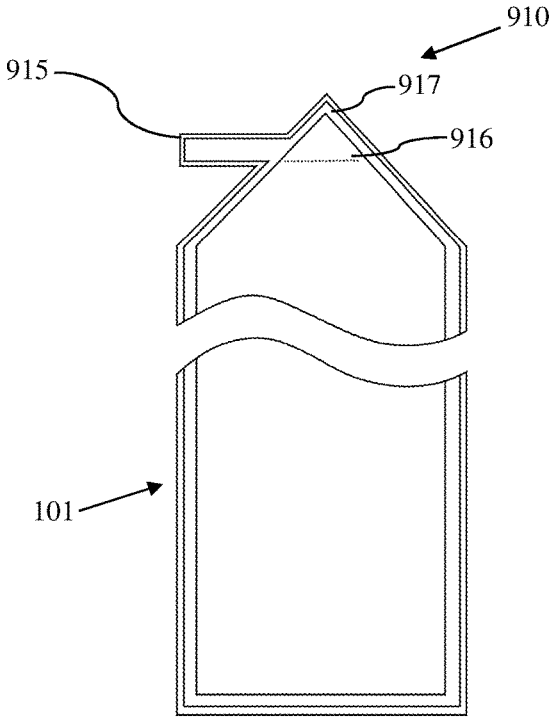
FIG. 10A is a top-down diagram of a tear tab applicator. The diagram illustrates the side-pull tab.

Tear applicator tip 910 is optionally tear tab 915 disposed perpendicular to the dispensing tip 917, as seen in FIG. 10A. In this variation, tear tab 915 is pulled by a user to remove the apex of dispensing tip 917 and leaving an opening on tear applicator tip 910. In some embodiments, a perforated line, tear line 916, runs parallel to tear tab 915.

Figure 10B:
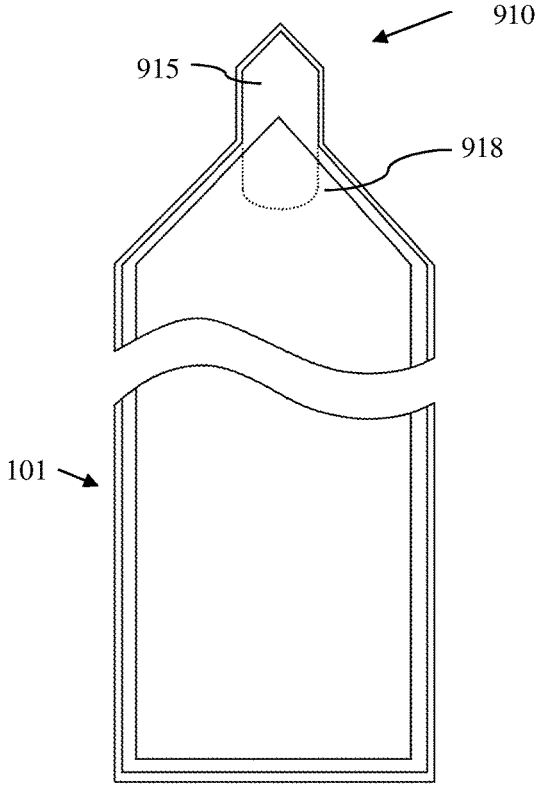
FIG. 10B is a top-down diagram of a tear tab applicator. The diagram illustrates the top-pull tab.

Alternatively, tear applicator tip 910 is optionally disposed parallel to the dispensing tip 917, as seen in FIG. 10B. In this variation, tear tab 915 is in communication with tear perforations 918 disposed on one wall of product chamber 101 or an opening in one wall of product chamber 101. Tear tab 915 is pulled by a user to access the perforations in the product chamber wall, thereby forming an opening in the wall, or tear tab 915 is peeled to expose an opening in the wall. In some variations, tear applicator tip 910 includes an adhesive forming a resealable tab, allowing for later use as well.

Example 10

Figure 11A:
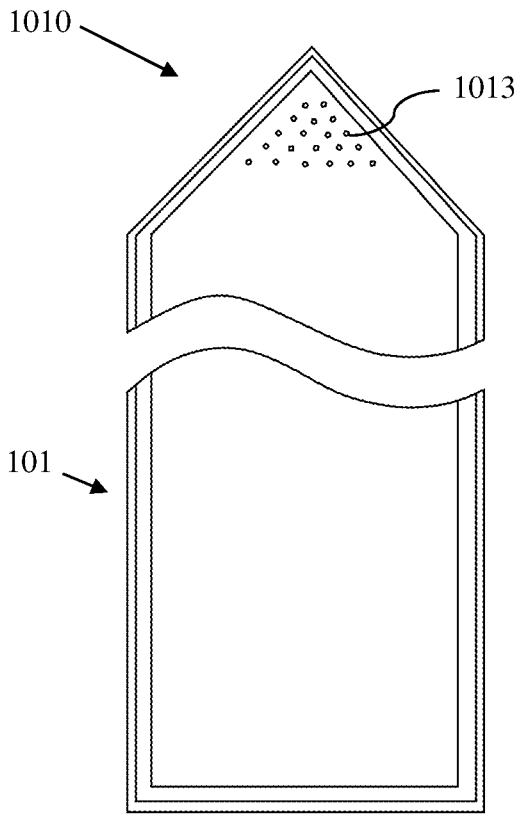
FIG. 11A is a top-down diagram of a shaker tab applicator.

Dispenser 10 includes product chamber 101 and shaker applicator tip 1010, seen in FIG. 11A. Product chamber 101 is formed of any suitable material, that forms at least two walls, and includes at least a first set of seals, as described in Example 1. In an exemplary embodiment, the at least a first set of seals, 151 through 154, as described in previous Examples. Product chamber 101 optionally includes second set of seals, 161 through 165, as described above.

Figure 11B:
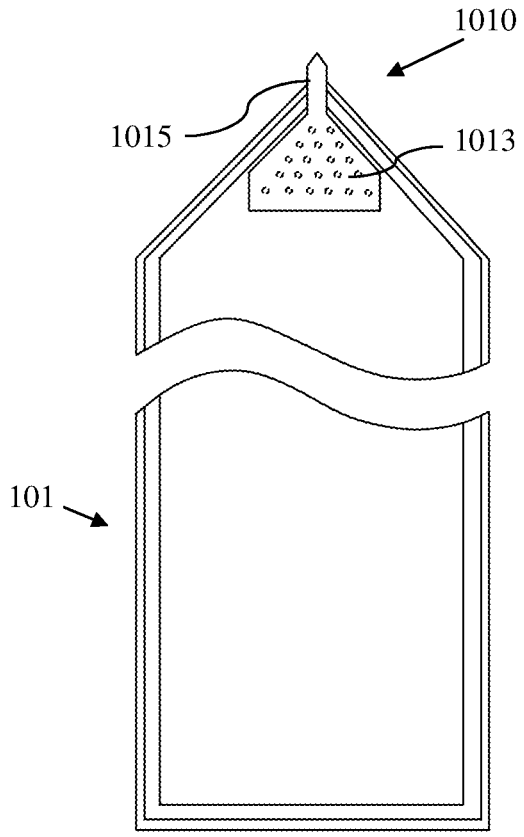
FIG. 11B is a top-down diagram of a shaker tab applicator having a sealable pull tab.

Shaker applicator tip 1010 is configured to dispense granular semi-fluid products, such as sugar, salt, pepper, garlic, oregano, coffee creamers, energy powders etc. to be dispensed upon shaking the package. A plurality of openings 1013 are disposed on one wall of product chamber 101. In some variations, a tear tab, such as the parallel tear tab disclosed in Example 9, is used to seal shaker applicator tip 1010 until use, as seen in FIG. 11B. Shaker tab 1015 is optionally disposed parallel to the shaker tip, however, other variations, including perpendicular, are also envisioned. The tear tab optionally includes a resealable function, as disclosed in that Example. In alternative variations, a safety seal or peel-off is disposed at the tip of these shaker-holes, allowing protection and cleanliness prior to opening, as well as allowing an adhesive or stick-able resealing component, so the package can be reusable for later.

Example 11

Figure 12A:
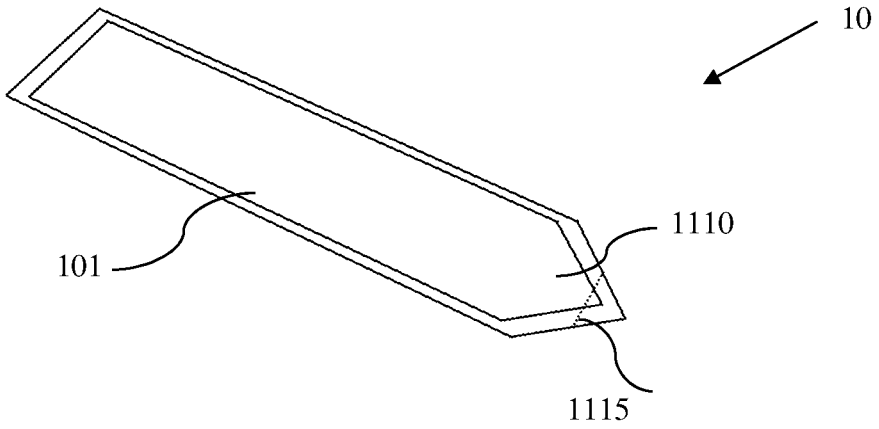
FIG. 12A is an isometric view of a writing dispenser tip in a first embodiment.
Figure 12B:
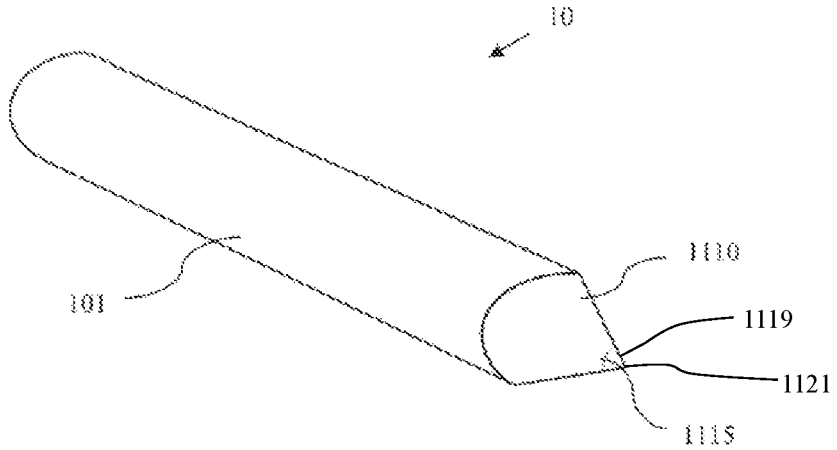
FIG. 12B is an isometric view of a writing dispenser tip in a second embodiment.
Figure 12C:
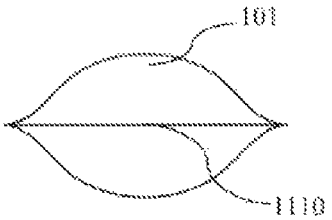
FIG. 12C is a top side view of a writing dispenser tip in a first embodiment.
Figure 12D:
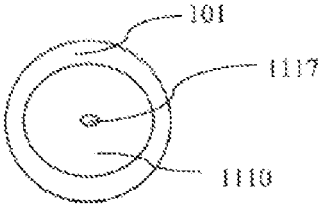
FIG. 12D is a top side view of a writing dispenser tip in a second embodiment.

Dispenser 10 includes product chamber 101 and writing tip 1110. The dispenser in this embodiment mimics a pencil, crayon, or pen having a flat base, as seen in FIG. 12A. Writing tip 1110 has a chevron shape or conical shape, including a conical tip 1119 that extends to a point, wherein the product opening is accessed via perforation 1115 that traverses around the writing tip 1110 at a base of the conic tip 1119. In some variations, product chamber 101 is rigid or semi-rigid, having a tubular structure, as seen in FIG. 12B. In these embodiments, writing tip 1110 is optionally semi-rigid or rigid, and include perforation 1115, such as that seen in FIG. 12C. Optionally, the product chamber includes a curvature to the body of the chamber, permitting a user to more securely grip and hold the dispenser. The base can also allow for easy standing, placement and storage when it is not in use. Upon removal of perforation 1115, a user may expel fluid or semi-fluid material from the product chamber using opening 1117 after removing conic tip 1117 at perforation 1115, as seen in FIG. 12D.

The base of product chamber 101 optionally includes an opening or port disposed on the base or adjacent to the base, thereby permitting a user to refill the product chamber.

Example 12

Figure 13A:
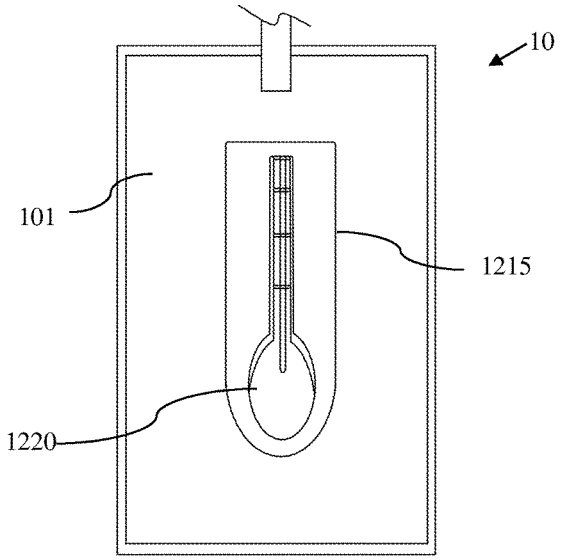
FIG. 13A is a top-down diagram of a utensil dispenser variation in a first embodiment.
Figure 13B:
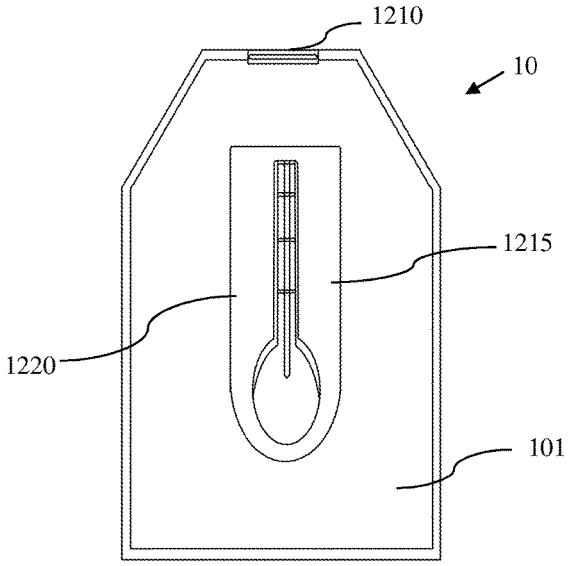
FIG. 13B is a top-down diagram of a utensil dispenser variation in a second embodiment.

Dispenser 10 includes product chamber 101 and product access tip 1210. Product chamber 101 includes integrated utensil pouch 1215 disposed on one wall of the product chamber, where utensil pouch 1215 is dimensioned to accept utensil 1220, as seen in FIG. 13A. The product access tip 1210 is optionally a tip disclosed in one prior example, or is formed of a resealable lock, as seen in FIG. 13B. In some variations, an opening is disposed on the product chamber wall, adjacent to utensil 1220. A pressure seal, such as a rubber or elastomeric material, is disposed around the opening and dimensioned to seal against utensil 1220, when utensil 1220 is placed against the product chamber wall.

Example 13

The applicator tip disclosed in the prior Examples is optionally formed of a translucent material in communication with a light source, such as a light emitting diode (LED). This illuminating component is disposed on top of the package and emits a glow that can be used in conjunction with, or separate from, the dispensing mechanism. This light component can be taken apart from the package and can be solar, battery, LED or electrically operated. The LED light may be in direct communication with the translucent material of the applicator tip or may be in communication via a fiber optic tubing or light guides.

Example 14

Figure 14A:
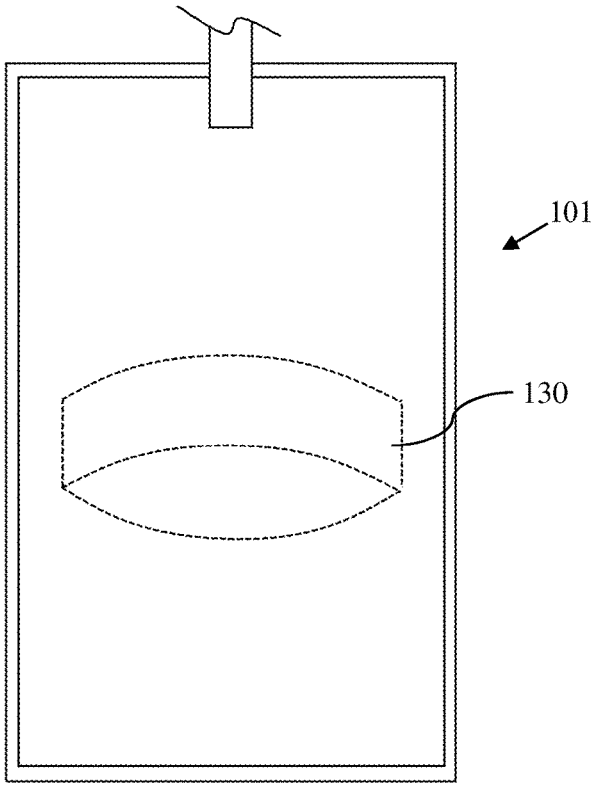
FIG. 14A is a top-down diagram of a transverse internal rigid expansion spring.
Figure 14B:
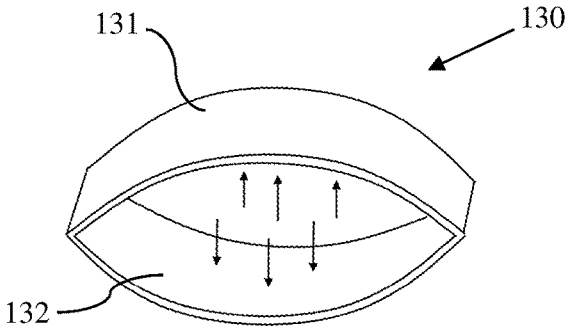
FIG. 14B is an isometric view of a transverse internal rigid expansion spring.
Figure 14C:
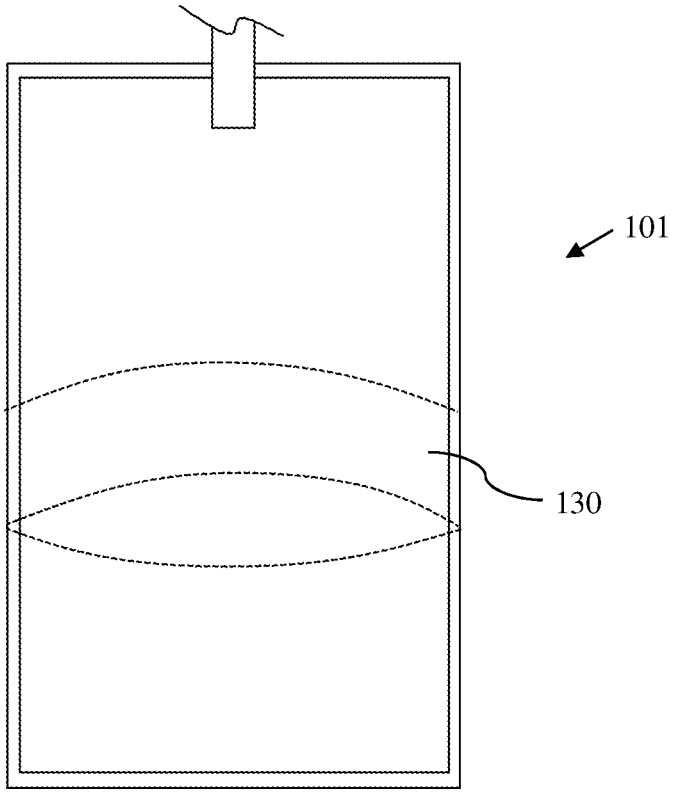
FIG. 14C is a top-down view of a transverse internal rigid expansion spring.

Product chamber 101 optionally includes transverse internal rigid expansion spring 130, as seen in FIG. 14A. Transverse internal rigid expansion valve 130 is disposed in the interior of product chamber 101 and is formed of a first spring leaf 131 and a second spring leaf 132, which are connected to form an almond shape, as seen in FIG. 14B. First spring leaf 131 and second spring leaf 132 are formed of plastic or an elastic metal, and connect to each other by means known in the art, such as welding, adhesive, polymerized resins. Transverse internal rigid expansion spring 130 can be used in any of the embodiments disclosed. In a first embodiment, the transverse internal rigid expansion spring fits within the interior of product chamber 101, as seen in FIG. 14A. In a second embodiment, the transverse internal rigid expansion spring is integrated into the seals of product chamber 101, as seen in FIG. 14C.

As external pressure is applied the transverse internal rigid expansion spring 130, product in product chamber 101 can be dispensed or applied. When the external pressure is released from the transverse internal rigid expansion spring 130, the transverse internal rigid expansion spring 130 returns to its starting shape (e.g., open) and opens as shown in FIG. 14B, which causes the product chamber 101 to expand and stop the fluid or semi-fluid material from flowing out of dispenser 10. Further, as transverse internal rigid expansion spring 130 opens, the spring causes product chamber 101 to withdraw product into the chamber. The transverse internal rigid expansion spring may also be used in the embodiments of the invention to provide a sucking functionality to the invention. Such vacuum function can be used to draw matter into the product chamber, such as oils on the skin.

Example 15

Figure 15A:
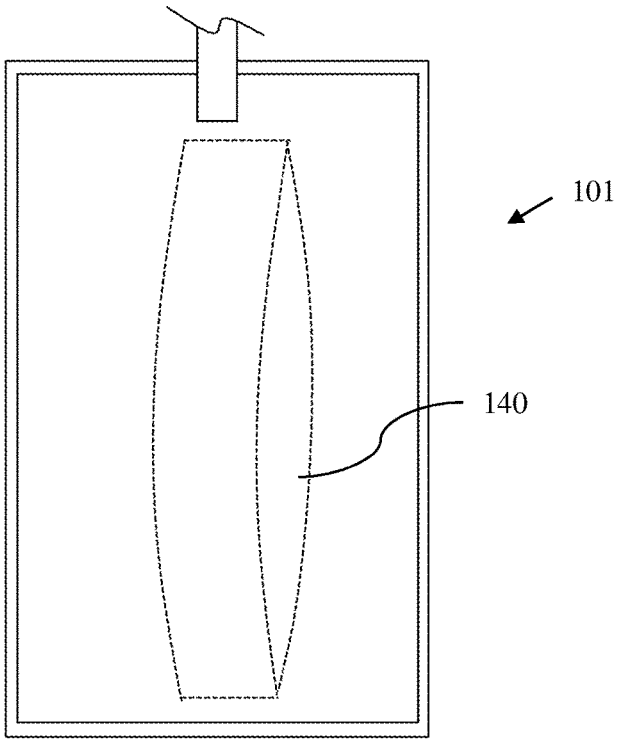
FIG. 15A is a top-down diagram of a longitudinal internal rigid expansion spring.
Figure 15B:
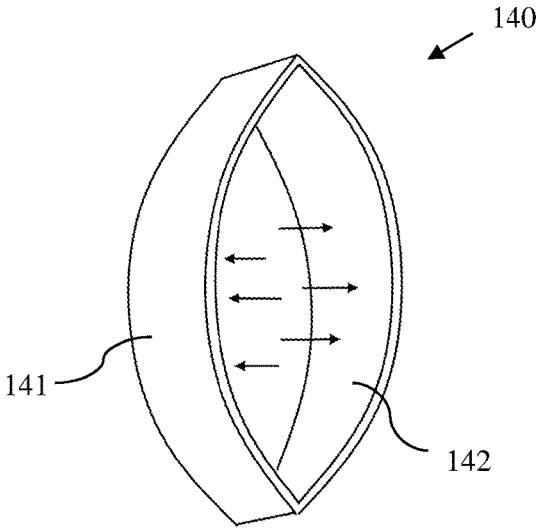
FIG. 15B is an isometric view of a longitudinal internal rigid expansion spring.

Product chamber 101 optionally includes longitudinal internal rigid expansion spring 140, as seen in FIG. 15A. Longitudinal internal rigid expansion valve 140 is disposed in the interior of product chamber 101 and is formed of a first spring leaf 141 and a second spring leaf 142, which are connected to form an almond shape, as seen in FIG. 15B. First spring leaf 141 and second spring leaf 142 are formed of plastic or an elastic metal, as disclosed in the previous example. The two leafs connect to each other by means known in the art, such as welding, adhesive, polymerized resins. Longitudinal internal rigid expansion spring 140 can be used in any of the embodiments disclosed.

When external pressure is applied to longitudinal internal rigid expansion spring 140, product in product chamber 101 can be dispensed or applied. When the external pressure is released from the transverse internal rigid expansion spring 130, longitudinal internal rigid expansion spring 140 returns to its starting shape (e.g., open) and opens as shown in FIG. 15A, which causes the product chamber 101 to expand and stop the fluid or semi-fluid material from flowing out of dispenser 10. Further, as longitudinal internal rigid expansion spring 140 opens, the spring causes product chamber 101 to withdraw product into the chamber. The transverse internal rigid expansion spring may also be used in the embodiments of the invention to provide a sucking functionality to the invention. Such vacuum function can be used to draw matter into the product chamber, such as oils on the skin.

In the preceding specification, all documents, acts, or information disclosed do not constitute an admission that the document, act, or information of any combination thereof was publicly available, known to the public, part of the general knowledge in the art, or was known to be relevant to solve any problem at the time of priority.

The disclosures of all publications cited above are expressly incorporated herein by reference, each in its entirety, to the same extent as if each were incorporated by reference individually.

While there has been described and illustrated specific embodiments of a dispenser and tips useful therein, it will be apparent to those skilled in the art that variations and modifications are possible without deviating from the broad spirit and principle of the present invention. It is also to be understood that the following claims are intended to cover all of the generic and specific features of the invention herein described, and all statements of the scope of the invention, which, as a matter of language, might be said to fall therebetween.

What is claimed is:

1. A dispenser, comprising:

a product chamber having a tubular structure;

a base at a first end of the tubular structure configured to allow the dispenser to be stood upright on the base;

an applicator tip opposite the base at a second end of the tubular structure and having a conical applicator shape, wherein the applicator tip is rigid and includes a removable conic tip that extends to a point, a perforation traverses around the applicator tip at a base of the conic tip, wherein removal of the conic tip at the perforation creates an opening through which a content contained in the product chamber can be dispensed.

2. The dispenser of claim 1, wherein the tubular structure comprises cardboard, high density cardboard, high density paper, plastic, paper, plastic film, foil, metalized film, or a metal sheet.

3. The dispenser of claim 1, further comprising a refill port on or adjacent the base.

* * * * *